US011013300B2

(12) United States Patent
Raille

(10) Patent No.: US 11,013,300 B2
(45) Date of Patent: May 25, 2021

(54) CONNECTING DEVICE FOR BRACELET

(71) Applicant: LVMH Swiss Manufactures SA, La Chaux-de-Fonds (CH)

(72) Inventor: Laurent Raille, Maiche (FR)

(73) Assignee: LVMH SWISS MANUFACTURES SA, La Chaux-de-Fonds (CH)

( * ) Notice: Subject to any disclaimer, the term of this patent is extended or adjusted under 35 U.S.C. 154(b) by 0 days.

(21) Appl. No.: 16/474,283

(22) PCT Filed: Dec. 29, 2017

(86) PCT No.: PCT/IB2017/058512
§ 371 (c)(1),
(2) Date: Jun. 27, 2019

(87) PCT Pub. No.: WO2018/127779
PCT Pub. Date: Jul. 12, 2018

(65) Prior Publication Data

US 2019/0335862 A1 Nov. 7, 2019

(30) Foreign Application Priority Data

Jan. 4, 2017 (CH) ..... 00008/17

(51) Int. Cl.
*A44C 5/24* (2006.01)
*A44C 5/18* (2006.01)
*A44C 5/20* (2006.01)

(52) U.S. Cl.
CPC ..... *A44C 5/185* (2013.01); *A44C 5/2042* (2013.01); *A44C 5/24* (2013.01); *Y10T 24/2155* (2015.01); *Y10T 24/4782* (2015.01)

(58) Field of Classification Search
CPC .... A44C 5/22; A44C 5/24; A44C 5/18; A44C 5/185; A44C 5/20; A44C 5/2042; Y10T 24/2166; Y10T 24/2155; Y10T 24/4782
See application file for complete search history.

(56) References Cited

U.S. PATENT DOCUMENTS 9,003,611 B2 * 4/2015 Catanese ..... A44C 5/24 24/71 J
9,615,634 B2 * 4/2017 Kaltenrieder ..... A44C 5/246
(Continued)

FOREIGN PATENT DOCUMENTS

CH 699188 A2 1/2010
CH 702726 A2 8/2011
(Continued)

OTHER PUBLICATIONS

International Search Report for PCT/IB2017/058512 dated Apr. 10, 2018.

*Primary Examiner* — Robert Sandy
*Assistant Examiner* — Michael S Lee
(74) *Attorney, Agent, or Firm* — Pearne & Gordon LLP

(57) ABSTRACT

Connecting device allowing a releasable connection between a bracelet strap and a folding clasp including at least two articulated arms and two fastening portions capable of reversibly cooperating with each other. The connecting device includes a first connecting piece capable of being secured to the free end of the bracelet strap and a second connecting piece capable of being mounted on the fastening portion. The first connecting piece and the second connecting piece are configured to reversibly cooperate with each other between a first, open position allowing separation of the first connecting piece and the second connecting piece and a second, closed position in which the first connecting piece and the second connecting piece are locked together.

15 Claims, 8 Drawing Sheets

(56) References Cited

U.S. PATENT DOCUMENTS

| | | | | |
|---|---|---|---|---|
| 2005/0262668 | A1* | 12/2005 | Ho | A44C 5/24<br>24/71 J |
| 2007/0125123 | A1* | 6/2007 | Sierro | A44C 5/246<br>63/3.2 |
| 2016/0081439 | A1* | 3/2016 | Catanese | A44C 5/246<br>63/3.1 |

FOREIGN PATENT DOCUMENTS

| | | | |
|---|---|---|---|
| EP | 1188389 | A1 | 3/2002 |
| EP | 1240841 | A1 | 9/2002 |

* cited by examiner

CONNECTING DEVICE FOR BRACELET

TECHNICAL FIELD

The present invention relates to a connecting device for a bracelet, particularly for a wristwatch bracelet.

More precisely, the present invention relates to a connecting device allowing a removable connection that can easily be detached, particularly without the aid of tools, between a bracelet strap and a folding clasp. A connecting device of this type makes the folding clasp interchangeable.

PRIOR ART

Wristwatches generally comprise a watch case with a case middle comprising lugs forming horns that are used for attaching the bracelet. The bracelet, meanwhile, comprises two bracelet straps and a clasp, particularly a folding clasp generally comprising two (sometimes three) articulated arms and two fastening portions capable of reversibly cooperating with each other for closing and opening the bracelet, by means of manipulation by the wearer using his/her other hand.

When it is desired to change the folding clasp (or the bracelet straps), the connection between the bracelet strap and one or other of the fastening portions of the folding clasp is unlocked and then detached generally with the aid of a tool.

Document EP1188389 makes provision for two pairs of connecting pieces for a folding clasp, the first pair of connection pieces being adapted to receive the straps of a flexible bracelet and the second pair of connecting pieces being adapted to receive the straps of a bracelet with rigid links.

Document EP1240841 describes a folding clasp, the two mutually articulated arms of which are each equipped with a device for fastening the end of a bracelet strap. One of these two fastening devices comprises a C-cover pivoting about an axis relative to the articulated arm and two studs forming retention members extending the ends of the C-cover parallel to the axis. The band forming the end of the strap can be assembled easily by its being slipped between the retention members of the cover and folded through 180° about the axis. In this case, the end bands of the straps are retained by wedging in the fastening device, in as much as they are under tension. Such a situation can adversely affect the adjustment of the length of these straps if the end band is no longer under tension, particularly in the case of a thin bracelet strap. Furthermore, this fastening device is unsuited to different bracelet strap lengths.

There is thus a need for a connecting device between a bracelet strap and a folding clasp or bracelet loop in order to enable this folding clasp to be interchanged without a tool.

There is also a need for a connecting device between a bracelet strap and a folding clasp to allow this bracelet strap to be interchanged without a tool.

There is also a need for a connecting device between a bracelet strap and a folding clasp that is adapted to the majority of bracelet straps and particularly bracelet straps of relatively different widths.

There is also a need for a connecting device between a bracelet strap and a folding clasp that ensures improved locking between the bracelet strap and the folding clasp.

BRIEF SUMMARY OF THE INVENTION

An object of the present invention is to propose a connecting device free of the limitations of known fastening devices or folding clasps.

According to the invention, these objects are achieved particularly by means of a connecting device allowing a releasable connection between a bracelet strap and a folding clasp comprising at least two articulated arms and two fastening portions capable of reversibly cooperating with each other, the connecting device comprising a first connecting piece capable of being secured to the free end of the bracelet strap and a second connecting piece capable of being mounted on the fastening portion.

In particular, said first connecting piece and said second connecting piece are configured to reversibly cooperate with each other between a first, open position allowing separation of the first connecting piece and the second connecting piece and a second, closed position in which said first connecting piece and said second connecting piece are locked together. In particular, in the first, open position of the connecting device the bracelet is open and in the second, closed position of the connecting device the bracelet may be either or closed (particularly worn around the wrist), with the bracelet strap firmly attached to the folding clasp.

It will be understood that said first connecting piece and said second connecting piece can move relative to each other. In one embodiment, said first connecting piece and said second connecting piece can move relative to each other, with the possibility of a rotational movement or a relative pivoting movement.

This solution offers, particularly, the advantage of simplifying disassembly and reassembly between the fastening portion of a folding clasp and the free end of a bracelet strap. A connecting device of this type further makes it possible to match together, without particular adaptation or transformation, traditional folding clasps and traditional bracelet straps of different sizes and thicknesses.

This solution offers, particularly, the advantage over the prior art that it is possible at the same time enable the bracelet straps and/or the folding clasp to be interchangeable and makes it possible for there to be a reliable fastening between the bracelet strap and the folding clasp using the connecting device according to the invention.

Indeed, the present invention makes it possible, without the aid of tools, by means of simple manipulation of the connecting device, by creating a relative movement between the first connecting piece and said second connecting piece, to pass from a first, open position allowing the release and separation of the first connecting piece and the second connecting piece (and thus between the bracelet strap and the folding clasp) to a second, closed position in which said first connecting piece and said second connecting piece are locked together, and vice versa. In one embodiment, such a movement is a relative movement of rocking or pivoting between the first connecting piece and the second connecting piece.

The result of this is that the folding clasp and the bracelet strap connected together by the connecting device according to the invention can be disassembled without tools.

In one embodiment, said first connecting piece comprises a fastening portion capable of being mounted on the end of the bracelet strap and a first locking portion capable of cooperating with said second connecting piece. In this first connecting piece, said fastening portion and said first locking portion are connected together. Preferably, said fastening portion and said first locking portion are connected together at their ends.

In one embodiment, said locking portion of the first connecting piece is a rod. Thus, this rod can be accommodated in a passage formed at the free end of the bracelet strap. According to a variant embodiment, said rod forming the first locking portion of the first connecting piece has, on at least one section of its length, an oblong or elongated cross section. A shape such as this promotes locking between the first connecting piece and the second connecting piece.

In one embodiment, said fastening portion of the first connecting piece is a rod. According to a variant embodiment, said rod forming the first locking portion of the first connecting piece has, over at least a portion of its length, a circular cross section.

In one embodiment, said fastening portion and said first locking portion of the first connecting piece are mutually parallel rods connected to each other via their ends.

In one embodiment, said second connecting piece comprises an connection portion capable of being mounted on the fastening portion of the folding clasp and a second locking portion capable of cooperating with said first locking portion of the first connecting piece.

In one embodiment, said connection portion of the second connecting piece has a loop form and is capable of pivoting about a rod of the fastening portion of the folding clasp. According to a variant, this connection portion is formed by a portion curved in the form of a loop capable of retaining, without the possibility of exit, the rod of the fastening portion of the folding clasp while allowing relative pivoting between the loop or connection portion and the rod of the fastening portion of the clasp. In this way, there can be relative movement between the connection portion and the rod of the fastening portion of the clasp.

In one embodiment, said second locking portion of the second connecting piece has a hook form with an opening. This second locking portion in hook form is capable of allowing the exit of said first locking portion from the first connecting piece in the first, open position and is capable of retaining the first locking portion of the first connecting piece in the second, closed position. According to a variant, this second locking portion is formed by a portion curved in the form of a hook, that is to say an open loop, which delimits an opening. It will be understood that this opening allows the release, that is to say allows the passage outside this second locking portion, of the first locking portion of the first connecting piece in the first, open position of the connecting device.

In one embodiment, said second connecting piece forms a connecting tongue. It will be understood that such a piece is very easily manufactured, for example from a plate, two opposite sides of which are curved in the direction of the same face of the plate (connecting tongue), one in the form of a hook (open loop) to form the second locking portion and the other in the form of a loop (closed hook, without an opening) to form said connection portion.

The present invention also relates to a closure device for a bracelet comprising a folding clasp comprising at least two articulated arms and two fastening portions capable of reversibly cooperating with each other, and a connecting device as described above, wherein said second connecting piece is mounted pivotably on the fastening portion.

The invention also relates to a bracelet comprising two bracelet straps and a folding clasp comprising at least two articulated arms and two fastening portions capable of reversibly cooperating with each other. A bracelet of this type further comprises a connecting device, as described above, arranged between a fastening portion of the clasp and the end of one of the bracelet straps. In one embodiment, a bracelet of this type constitutes the bracelet of a wristwatch.

In one embodiment, in which said second locking portion of the second connecting piece has the form of a hook with an opening, the arms of the folding clasp close off the opening of the second locking portion of the second connecting piece in said second, closed position of the connecting device. Thus, it will be understood that the arms of the folding clasp contribute to improving locking between the first connecting piece and the second connecting piece, and thus between the bracelet strap and the corresponding fastening portion of the folding clasp.

In one embodiment, said second connecting piece extends at least over the width of the free end of the bracelet strap. At one and the same time, this guarantees greater mechanical stability for the join between the fastening portion of the folding clasp and the free end of the bracelet strap and also an improved aesthetic appearance, by means of an extension also visible between the fastening portion of the folding clasp and the free end of the bracelet strap.

In one embodiment, said two bracelet straps are straps of a flexible bracelet.

In one embodiment, said two bracelet straps are straps of a bracelet with rigid links.

The invention also relates to a watch comprising a watch case and bracelet, said bracelet having two bracelet straps and a folding clasp comprising at least two articulated arms and two fastening portions capable of reversibly cooperating with each other for closing and opening the bracelet, said bracelet further having at least one connecting device, as described above, arranged between a fastening portion of the clasp and the end of one of the bracelet straps.

Furthermore, generally, the present invention relates to an object designed to be worn on the wrist, comprising an article and a bracelet, said bracelet having two bracelet straps and a folding clasp comprising at least two articulated arms and two fastening portions capable of reversibly cooperating with each other for closing and opening the bracelet, said bracelet further having at least one connecting device, as described above, arranged between a fastening portion of the clasp and the end of one of the bracelet straps. An article of this type may be decorative or ornamental, particularly a jewel or other decoration, and/or an article with a use, such as a box with a lid, a compass, a chronometer or chronograph, a telephone, a weather station, an alarm, a device for detecting a physiological parameter, such as heartbeat, etc.

BRIEF DESCRIPTION OF THE DRAWINGS

An exemplary embodiment of the invention is indicated in the description illustrated by the appended figures, in which.

EXEMPLARY EMBODIMENT(S) OF THE INVENTION

Customarily, in bracelets for wristwatches, one of the two straps of the bracelet comprises a passage or hole at its free end to be coupled to the clasp by a fastening system. A rod (particularly a spring bar) traverses this hole (passage) and is thus mounted in one end of the clasp. Mounting and detachment of each strap of the bracelet requires a tool, such as a screwdriver or a needle.

The embodiment illustrated in FIGS. 1 to 11 shows a connecting device 40 as claimed in the invention allowing the mounting and dismounting of a bracelet strap 20 connected (on the left) to a fastening portion 31 of a folding clasp 30.

Figure 1:
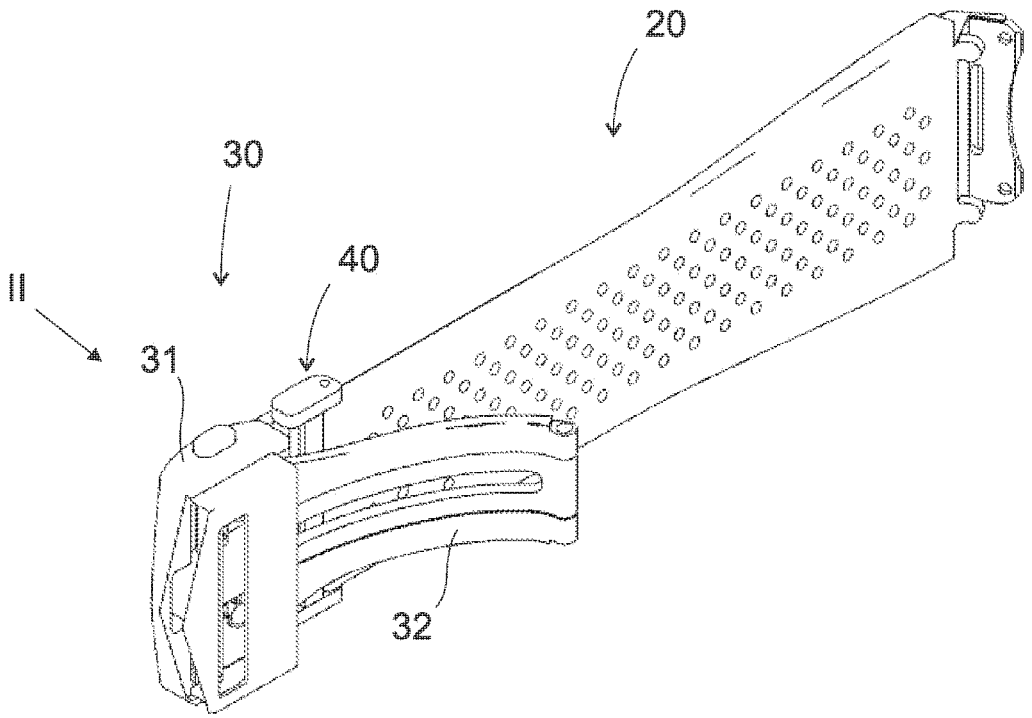
FIG. 1 illustrates, in perspective, one half of a wristwatch equipped with the connecting device as claimed in the present invention, seen from the rear face, in the closed position of the connecting device.
Figure 2:
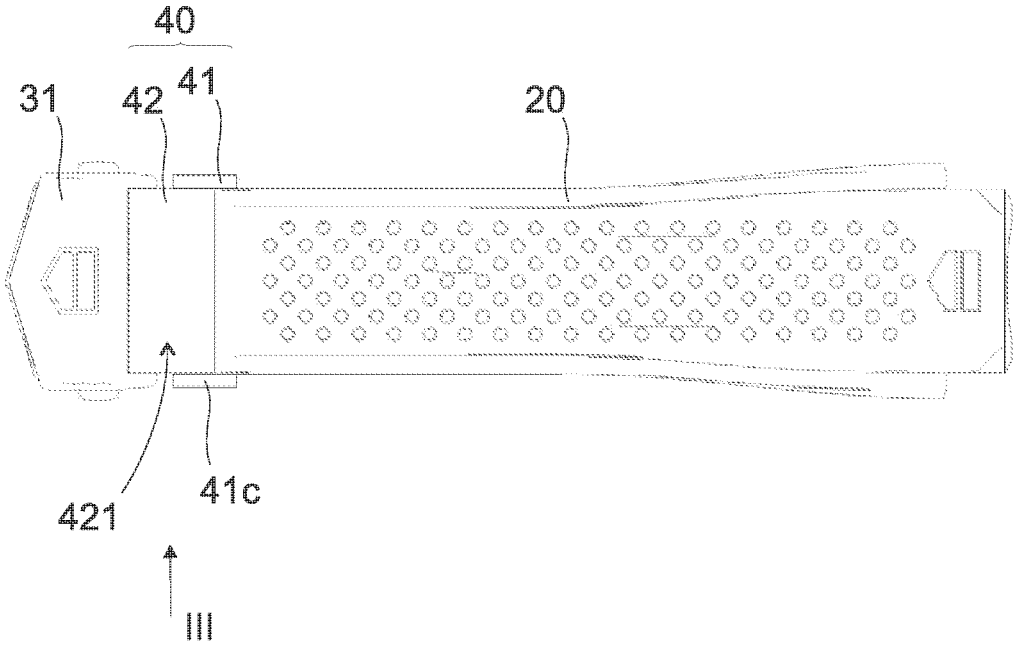
FIG. 2 shows one half of the wristwatch of FIG. 1, seen from above, in the direction II in FIG. 1.
Figure 3:
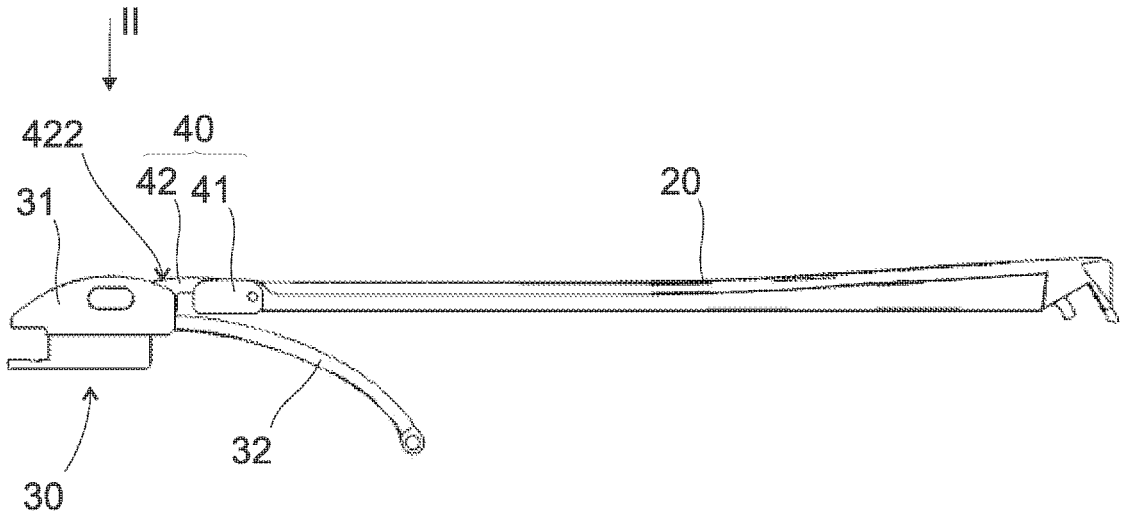
FIG. 3 shows one half of the wristwatch of FIG. 1, seen from the side, in the direction III in FIG. 2, FIG. 4 corresponds to the left-hand portion of FIG. 3, shown in an enlarged form.
Figure 4:
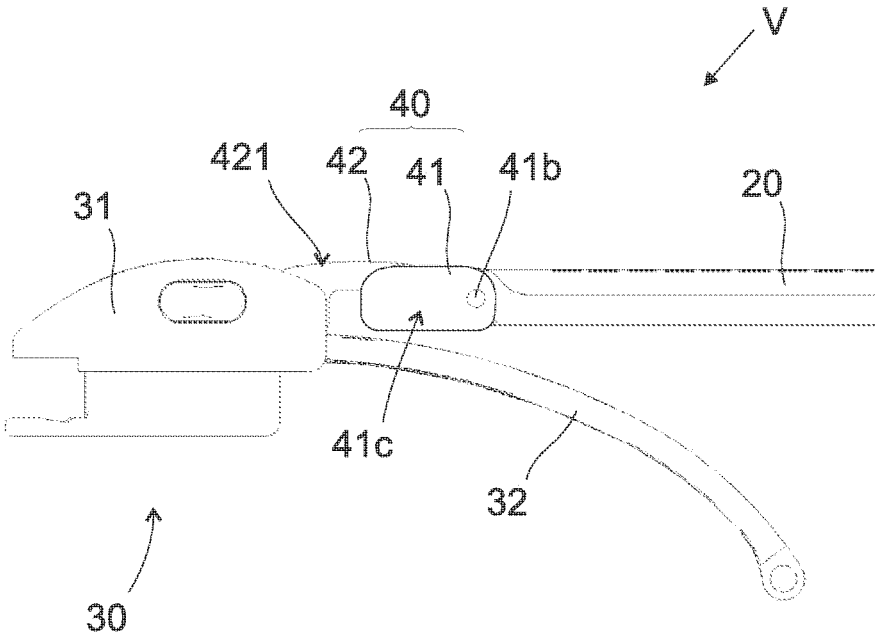
Figure 5:
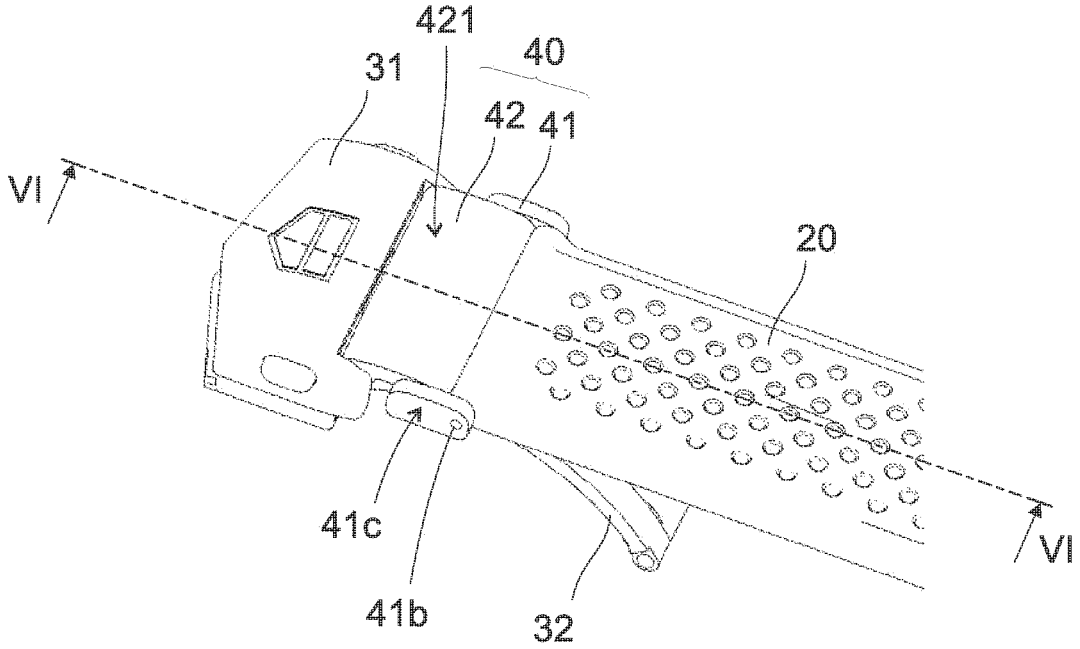
FIG. 5 shows the portion of the half of the wristwatch in FIG. 4 in perspective, from the side and from above, in the direction V in FIG. 4.

As may be seen in FIG. 1, the bracelet strap 20 is connected (on the left) to the fastening portion 31 of the folding clasp 30, the other, free end (on the right) of the bracelet strap 20 being designed to be connected to a watch case. The reversible mechanical link between the bracelet strap 20 and the fastening portion 31 is thus provided by the connecting device 40 that is the subject of the present invention. This FIG. 1 also shows an articulated arm 32 of the folding clasp 30, also attached to the fastening portion 31 of the folding clasp 30, the articulated arm 32 being designed to cooperate with the other strap of the bracelet (not shown).

The elements described above are shown in FIGS. 2 to 5, which further show the first connecting piece 41 and the second connecting piece 42 of the connecting device 40.

When its components are mounted together, the first connecting piece 41 of the connecting device 40 is in the form of two mutually parallel rods 41*a*, 41*b* connected at each end via a connecting plate 41*c*. The rod 41*b* (on the right in FIGS. 6 and 7) can be removed, is generally constituted by a spring bar, and forms a fastening portion 41*b* that cooperates with the free end (on the left in FIGS. 6 and 7) of the bracelet strap 20 for permanent mounting with the bracelet strap 20 (detachment using a tool still being possible in order to detach the rod 41*b* from the connecting piece 41, by disengagement of the ends of the rod 41*b* outside an associated housing present in each connecting plate 41*c*, thereby releasing the strap of the bracelet).

In particular, the fastening portion 41*b* is a rod of circular cross section housed in the transverse passage 21 formed in the free end (on the left in FIGS. 6 and 7) of the bracelet strap 20. This configuration allows a pivoting movement between the fastening portion 41*b* and bracelet strap 20. Generally, in the present text, the adjective "longitudinal" denotes a direction in which the bracelet strap, placed flat, extends, and the adjective "transverse" corresponds to a direction orthogonal to the longitudinal direction, corresponding to the width of the bracelet strap.

The rod 41*a* (on the left in FIGS. 6 and 7) forms a first locking portion 41*a* of the connecting device 40 and is preferably mounted permanently via its ends on the two connecting plates 41*c*. This first locking portion 41*a* reversibly cooperates with the second connecting piece 42 of the connecting device 40, as will be described below.

Figure 10:
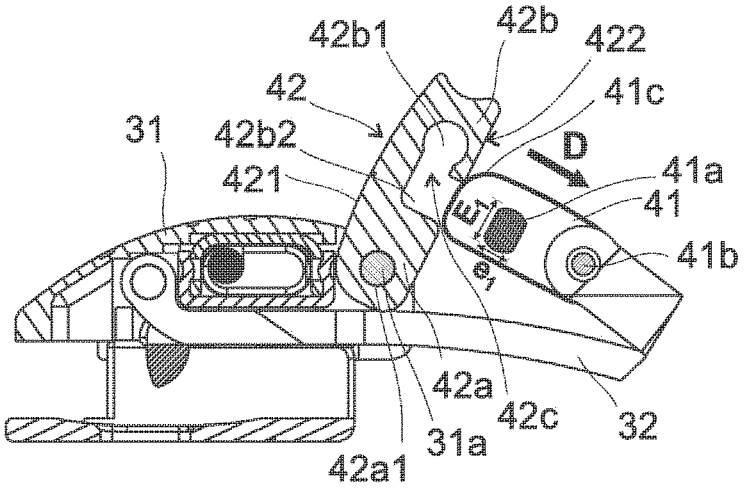
Figure 11:
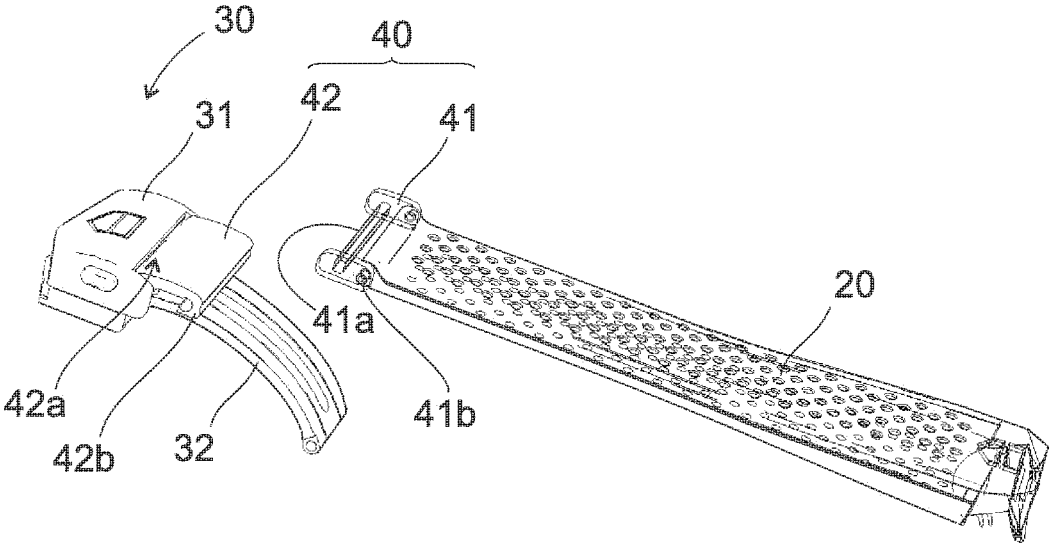
FIG. 11 illustrates, in perspective, one half of an equipped wristwatch in FIG. 1, seen from the front face, in the open position of the connecting device and resulting from separation of the first connecting piece and the second connecting piece.

As may be seen in FIGS. 6 to 10, the first locking portion 41*a* is a cylindrical rod that has a cross section (or guiding curve) of globally elongate or oblong form. More precisely, as may be seen in FIGS. 6 to 10, this first locking portion 41*a* has, in cross section, a form delimited by two convex circular arcs and by two mutually parallel rectilinear sections each delimiting a flat along this rod. Each rectilinear section connects an end of one of the circular arcs to an end of the other of the circular arcs. Furthermore, it is noted that the two rectilinear sections are parallel to each other, one of the rectilinear sections being positioned between the other of the rectilinear sections and the fastening portion 41*b*. Thus, as shown in FIG. 10, the distance e1 separating the two rectilinear sections (and which corresponds to the smallest thickness of the first locking portion 41*a*) is shorter than the distance E1 separating the two circular arc-shape sections (and which corresponds to the greatest thickness of the first locking portion 41*a*).

It is therefore understood that the fastening portion 41*b* and the first locking portion 41*a* of the first connecting piece 41 are mutually parallel rods connected to each other via their ends by means of fastening plates 41*c*.

The second connecting piece 42 of the connecting device 40 is in the form of a connecting tongue extending in a transverse direction of the folding clasp 30 and of the bracelet strap 20. The second connecting piece 42 of the connecting device 40 has an external face 421, which is continuously solid and practically flat, designed to be positioned in an opposite direction relative to the bracelet wearer's wrist and an internal face 422 designed to face the bracelet wearer's wrist.

Figure 6:
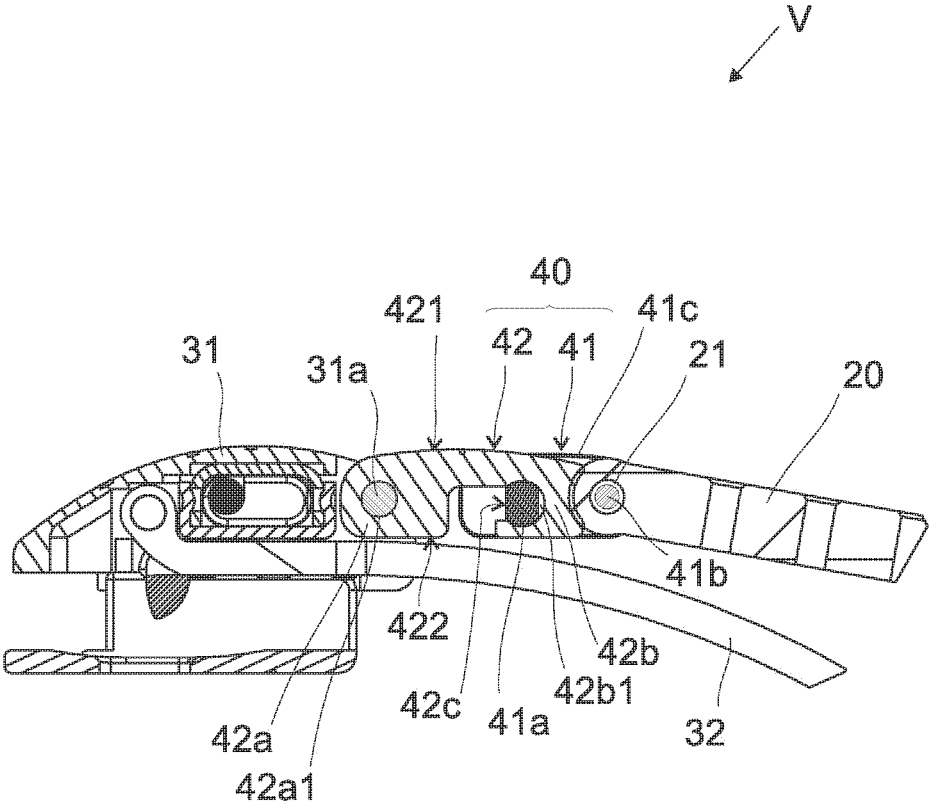
FIG. 6 shows the view in longitudinal section of the portion of the half of the wristwatch in FIGS. 4 and 5 in the direction VI-VI in FIG. 5, FIG. 7 to 10 show the same view as FIG. 6 in the case of the intermediate positions and the open position of the connecting device according to the invention.
Figure 7:
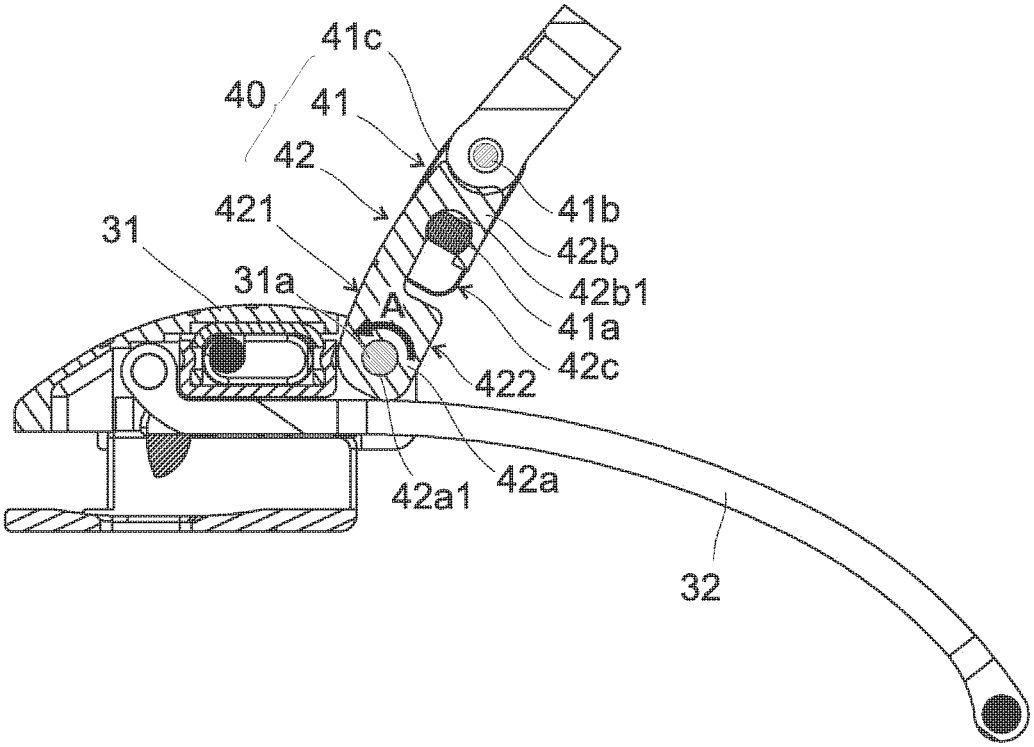
Figure 8:
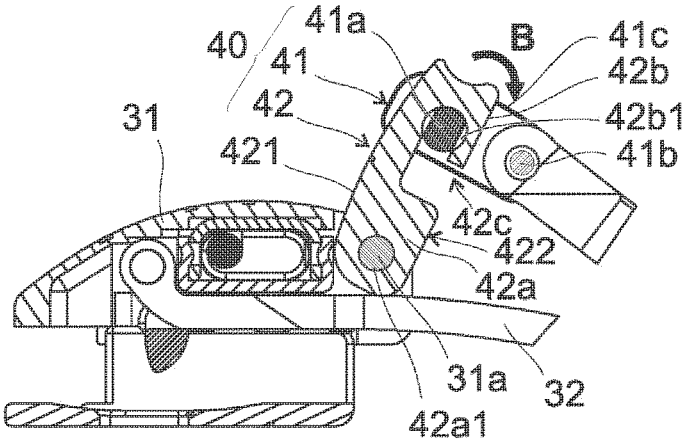
Figure 9:
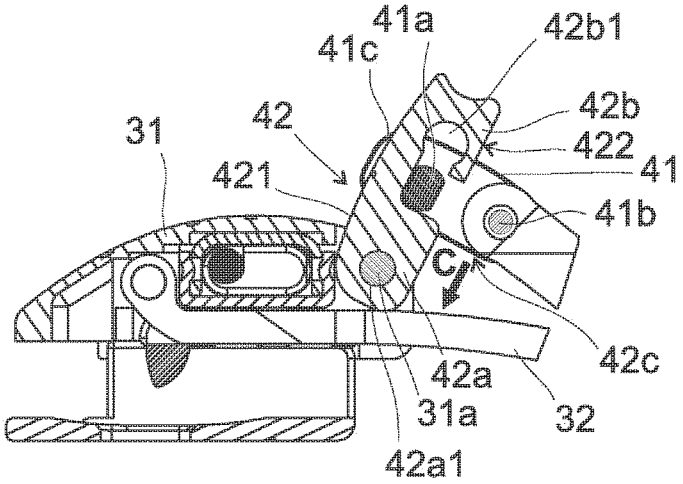

The second connecting piece 42 has a connection portion 42*a* (on the left in FIGS. 6 and 7) and a second locking portion 42*b* (on the right in FIGS. 6 and 7).

In particular, the connection portion 42*a* forms a tubular portion, with a cross section in the form of a loop, which delimits a transverse passage 42*a*1 receiving, with the possibility of pivoting, a rod 31*a* of circular cross section of the fastening portion 31 of the folding clasp 30 (on the left in FIGS. 6 and 7) of the bracelet strap 20. This configuration allows a pivoting movement between the fastening portion 31 of the folding clasp 30 and the second connecting piece 42 about the rod 31*a*.

The second locking portion 42*b* of the second connecting piece 42 is also a tubular portion extending in a transverse direction of the folding clasp 30 and of the bracelet strap 20, and it is not only open at its two ends but also along the transverse direction, in the direction of the connection portion 42*a* via an opening 42*c*. In this way, said opening 42*c* will allow, in a first, open position shown in FIGS. 8, 9 and 10, the exit of the first locking portion 41*a* outside of the second connecting piece 42. In particular, this tubular portion forms a transverse housing 42*b*1 of circular cross section, with a diameter equal to or slightly greater than the distance E1 separating the two circular arc-shape sections of the first locking portion 41*a*. In order to ensure effective locking in the closed position of the connecting device 40, said opening 42*c* has a width that is less than the distance E1 separating the two circular arc-shape sections of the first locking portion 41*a*, and greater than the distance e1 separating the two rectilinear sections of the first locking portion 41*a*.

A description will now be given, in connection with FIGS. 6 to 10, of the maneuver for releasing the first connecting piece 41 and the second connecting piece 42.

During a first pivoting movement (arrow A in FIG. 7), the second connecting piece 42 of the connecting device 40 is turned manually about the rod 31*a* of the fastening portion 31 of the folding clasp 30 in a first direction (counterclockwise in FIG. 7). Prior to this maneuver, it should be pointed out (see FIG. 3) that the hook formed by the second locking portion 42*b* is closed by the articulated arm 32 of the folding clasp 30, this articulated arm 32 facing the internal face 422 of the second connecting piece 42. After this maneuver, the opening 42*c* is spaced apart from the articulated arm 32 of the folding clasp 30, the hook formed by the second locking portion 42*b* then being open at the level of the internal face 422 of the second connecting piece 42.

In this intermediate position, which can be seen in FIG. 7, the first locking portion 41*a* is still arranged in the transverse housing 42*b*1, without the possibility of existing via the opening 42*c* because one of the two rectilinear sections of the first locking portion 41*a* is facing the opening 42*c*.

During a second pivoting movement (arrow B in FIG. 8), the first connecting piece 41 of the connecting device 40 is turned manually about the first locking portion 41*a* in a second direction (clockwise in FIG. 8), opposite to the first direction used for the first pivoting movement. After this maneuver, the hook formed by the second locking portion 42*b* is still open and the first locking portion 41*a* is still arranged in the transverse housing 42*b*1 with, this time, one of the two circular arcs of the first locking portion 41*a* facing the opening 42*c*.

Then, by means of a first translational movement (arrow C in FIG. 9, downward), the first locking portion 41*a* is made to exit outside the transverse housing 42*b*1. The first locking portion 41*a* then abuts against the connection portion 42*a*.

During a second translational movement (arrow D in FIG. 10, from left to right), the first locking portion 41*a* is caused to exit outside the second connecting piece 42, via the opening 42*c* of the transverse housing 42*b*1, which extends via a transverse cavity 42*b*2 opening out on the internal face 422 with a dimension greater than E1, which makes it possible to separate the first connecting piece 41 from the second connecting piece 42 and hence to separate the folding clasp 30 of the bracelet strap 20.

The operations described above are implemented in reverse order in order to mount the bracelet strap 20 on the fastening portion 31.

Thus, the first connecting piece 41 and the second connecting piece 42 are movable relative to each other. This relative movement is achieved by means of a simple manipulation without a tool, preferably using the hand, particularly by performing a relative pivoting between the first connecting piece 41 held in one hand and the second connecting piece 42 held in the other hand.

The folding clasp 30 illustrated partially in FIGS. 1 to 11 comprises two arms articulated on each other by one of their ends. Naturally, the invention also applies to a folding clasp that comprises three parts (three arms) articulated relative to each other.

On the other side of the folding clasp 30, there is a further fastening portion (not shown) of the folding clasp 30, which is connected to the other bracelet strap (not shown) by means of a conventional fastening system as described above or, alternately, by a connecting device as claimed in the invention as described above.

At their end that is to be connected to the watch case, the bracelet straps comprise a fastening system, particularly a toolless quick-fastening system.

REFERENCE NUMBERS USED IN THE FIGURES

20 Bracelet strap
21 Transverse passage
30 Folding clasp or bracelet loop
31 Fastening portion
31*a* Rod of circular cross section
32 Articulated arm
40 Connecting device
41 First connecting piece
41*a* First locking portion (rod of oblong cross section)
41*b* Fastening portion (rod of circular cross section)
41*c* Connecting plate
42 Second connecting piece
42*a* Connection portion (loop)
42*a*1 Transverse passage
42*b* Second locking portion (hook)
42*b*1 Transverse housing (of circular cross section)
42*b*2 Transverse cavity
42*c* Opening
421 External face
422 Internal face
A Arrow (first pivoting movement)
B Arrow (second pivoting movement)
C Arrow (first translational movement)
D Arrow (second translational movement)
e1 Smaller thickness of the first locking portion 41*a*
E1 Greater thickness of the first locking portion 41*a*

What is claimed is:

1. A connecting device allowing a releasable connection between a first bracelet strap and a folding clasp comprising at least two articulated arms and a fastening portion, the connecting device comprising:

a first connecting piece capable of being secured to a free end of the first bracelet strap; and a second connecting piece capable of being mounted on the fastening portion of the folding clasp, wherein said first connecting piece and said second connecting piece are configured to reversibly cooperate with each other between a first, open position allowing separation of the first connecting piece and the second connecting piece and a second, closed position in which said first connecting piece and said second connecting piece are locked together, wherein said first connecting piece comprises a first locking portion capable of cooperating with said second connecting piece, said first locking portion of the first connecting piece being a rod, and wherein said rod forming the first locking portion of the first connecting piece has, on at least one section of its length, an oblong cross section which enables the first and second connecting pieces to be locked in said closed position.

2. The connecting device as claimed in claim 1, wherein said first connecting piece comprises a fastening portion capable of being mounted on the end of the first bracelet strap.

3. The connecting device according to claim 2, wherein said fastening portion and said first locking portion of the first connecting piece are mutually parallel rods connected to each other via their ends.

4. The connecting device according to claim 1, wherein said second connecting piece comprises a connection portion capable of being mounted on the fastening portion of the folding clasp and a second locking portion capable of cooperating with said first locking portion of the first connecting piece.

5. The connecting device according to claim 4, wherein said connection portion of the second connecting piece has a loop form and is capable of pivoting about a rod of the fastening portion of the folding clasp.

6. The connecting device according to claim 4, wherein said second locking portion of the second connecting piece has a hook form with an opening, capable of allowing the exit of said first locking portion from the first connecting piece in the first, open position and capable of retaining the first locking portion of the first connecting piece in the second, closed position.

7. The connecting device according to claim 4, wherein said second connecting piece forms a connecting tongue.

8. A closure device comprising the connecting device according to claim 1 and the folding clasp, wherein said second connecting piece is mounted pivotably on the fastening portion of the folding clasp.

9. A bracelet comprising the connecting device according to claim 1, the first bracelet strap, a second bracelet strap, and the folding clasp, said connecting device being arranged between the fastening portion of the folding clasp and the free end of the first bracelet strap.

10. The bracelet according to claim 9, wherein:

said second connecting piece comprises a connection portion capable of being mounted on the fastening portion of the folding clasp and a second locking portion capable of cooperating with said first locking portion of the first connecting piece, said second locking portion of the second connecting piece has a hook form with an opening, capable of allowing the exit of said first locking portion from the first connecting piece in the first, open position and capable of retaining the first locking portion of the first connecting piece in the second, closed position, and in said second, closed position of the connecting device, the at least two articulated arms of the folding clasp close off the opening of the second locking portion of the second connecting piece.

11. The bracelet according to claim 10, wherein said first bracelet strap and second bracelet strap are straps of a flexible bracelet.

12. The bracelet according to claim 10, wherein said first bracelet strap and second bracelet strap are straps of a bracelet with rigid links.

13. The bracelet according to claim 9, wherein said second connecting piece extends at least over a width of the free end of the bracelet strap.

14. A watch comprising a watch case and the bracelet according to claim 9.

15. An object designed to be worn on a wrist, the object comprising an article and the bracelet according to claim 9.

* * * * *